United States Patent [19]

Peterson

[11] 4,185,744

[45] Jan. 29, 1980

[54] CARTON FOR TAPERED WALL CONTAINERS

[75] Inventor: Bertel R. Peterson, San Juan Capistrano, Calif.

[73] Assignee: FBM International, Inc., Minneapolis, Minn.

[21] Appl. No.: 969,808

[22] Filed: Dec. 15, 1978

[51] Int. Cl.[2] ..... B65D 75/00

[52] U.S. Cl. ..... 206/427; 229/DIG. 8

[58] Field of Search ..... 206/427, 148, 151; 229/DIG. 8

[56] References Cited

U.S. PATENT DOCUMENTS

| | | | |
|---|---|---|---|
| 2,077,047 | 4/1937 | Kondulf | 229/DIG. 8 |
| 2,846,062 | 8/1958 | Paige | 206/149 |
| 3,143,273 | 8/1964 | Bunting | 206/139 |
| 3,412,852 | 11/1968 | Naumann | 206/148 |
| 3,593,849 | 7/1971 | Helms | 206/427 |
| 3,812,958 | 5/1974 | Samsing | 206/427 |
| 3,913,738 | 10/1975 | Olsen | 206/427 |

*Primary Examiner*—Herbert F. Ross

*Attorney, Agent, or Firm*—Schroeder, Siegfried, Ryan, Vidas, Steffey & Arrett

[57] ABSTRACT

A carton for carrying a plurality of tapered wall containers. The carton is formed from an integral blank and is cut and scored to permit it to be readily erected to receive a group of containers. A series of locks are formed in the upper surface of the erected carton to engage both the top cover and side wall of at least some containers and restrain their movement relative to each other and the carton to strengthen the package and prevent the containers from damaging each other.

5 Claims, 6 Drawing Figures

CARTON FOR TAPERED WALL CONTAINERS

DESCRIPTION

BACKGROUND OF THE INVENTION

This invention relates to cartons for carrying a plurality of tapered wall containers such as yogurt, cottage cheese containers, or similar type containers. In particular, this invention relates to an improved locking structure formed in the upper surface of the carton to engage and secure the tops and side walls of tapered wall containers to restrain their movement relative to each other and strengthen the carton and its contents to permit handling without damage to the containers.

Cartons for carrying cylindrical walled containers are well-known. Some of those cartons also include locking means for securing the containers to prevent their movement within the carton. Examples of this type of structure are shown, for example, in U.S. Pat. Nos. 3,300,119, to Chaussadas, and 3,143,273, to Bunting et al. Neither of these patents and the specialized securing means to which they pertain are suitable or intended to be used maintaining tapered wall containers with caps in a secure arrangement in a carton.

A principal object of this invention is, therefore, to provide an improved carton with locking means to secure capped tapered wall containers and is readily formed and adjusted at the time the carton is filled.

Another object of this invention is to provide an improved and simple locking structure from the upper surface of a carton panel blank.

SUMMARY

This invention provides an improved carton with a locking arrangement which is simply formed by cutting and scoring the top panel to form a pair of tabs which may be folded downwardly after the tapered wall containers are loaded into the carton to engage both the top and side wall of two diagonally opposed containers. The tabs cooperate to secure the containers against movement in the carton and have the effect of strengthening the carton and its contents so that it can be readily handled without damage to the individual containers.

Other details, uses, and advantages of this invention will become apparent from examination of the following description of the preferred embodiment thereof presented in the accompanying drawings.

BRIEF DESCRIPTION OF THE DRAWINGS

The drawings show a preferred embodiment of this invention in which.

DESCRIPTION OF THE PREFERRED EMBODIMENTS

Figure 1:
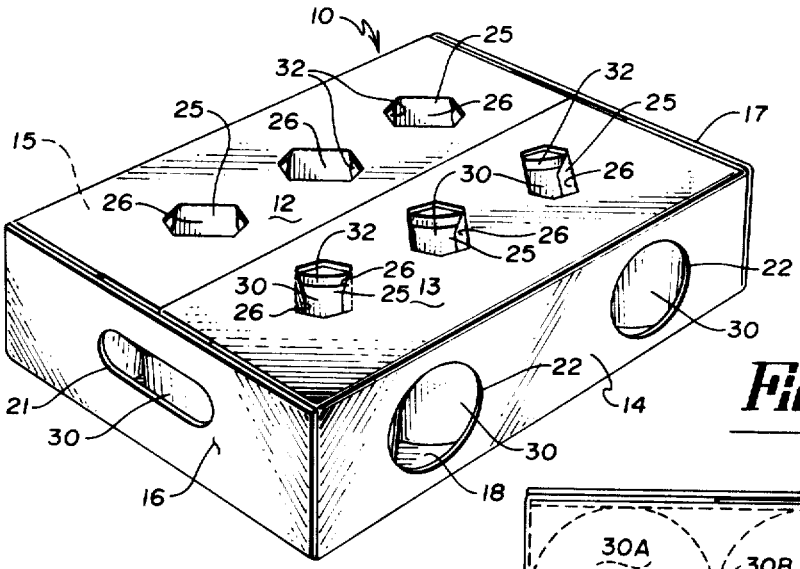
FIG. 1 is a perspective view of the assembled carton.

Referring to FIG. 1, reference numeral 10 refers generally to the carton which is formed from a single sheet of cardboard and folded along score lines to form a closed carton with top panels 12 and 13, side panels 14, 15, 16, and 17, and bottom panel 18. Side panels 16 and 17 are provided with carrying openings 21 and side panels 14 and 15 are provided with window openings 22.

Figure 2:
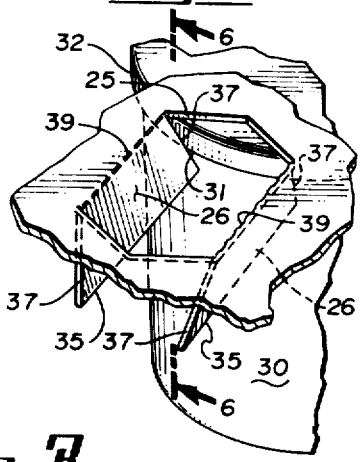
FIG. 2 is an enlarged perspective view of a single lock, showing the interaction of the side edges of the flap and the top and side of the container.
Figure 3:
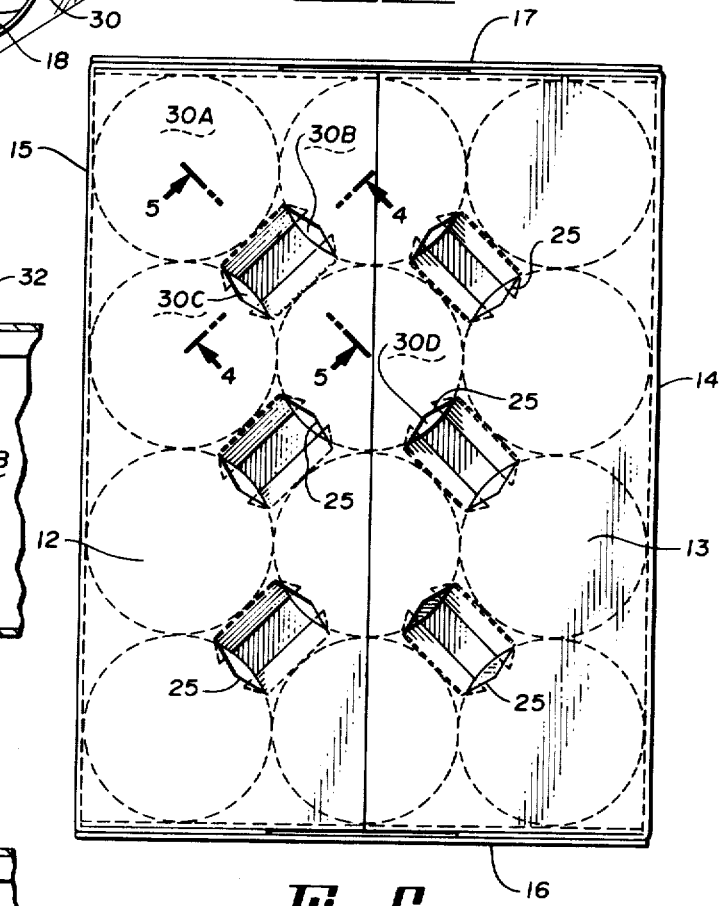
FIG. 3 is a top view of the carton, showing the arrangement of the locks and, in phantom outline, the tops of the tapered wall containers.
Figure 4:
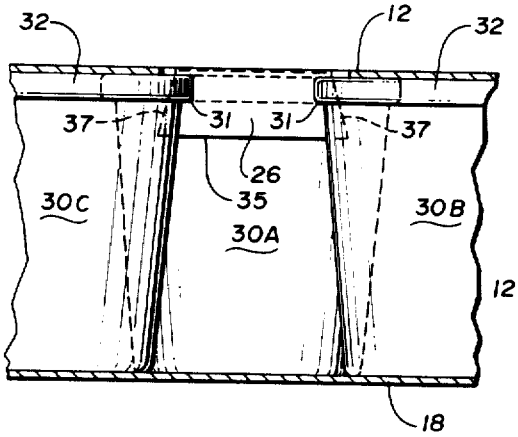
FIG. 4 is a cross-section taken along section lines 4—4 in FIG. 3.
Figure 5:
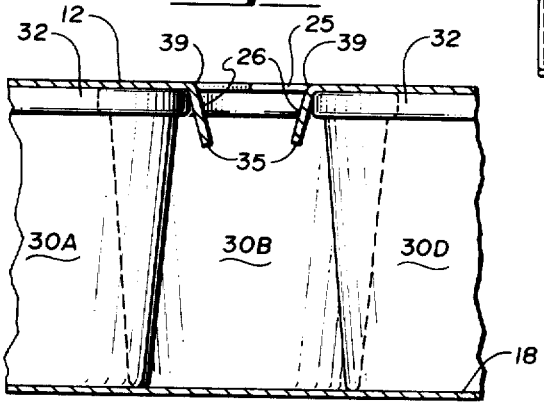
FIG. 5 is a cross-section taken along section line 5—5.

Top panels 12 and 13 include article restraining locks 25, each of which is comprised of a pair of downwardly folded flaps 26 which are struck from the top panel. FIG. 3 shows the orientation of six article restraining locks and the phantom outline of the tops of the articles 30 which are to be carried within carton 10. Articles 30 are also generally shown in FIGS. 2, 4 and 5 and their relative position within the box are indicated by suffixes A through D.

Articles 30 are characterized in the embodiment shown by a generally circular horizontal cross-section and include a flanged projection 31 at their top. For example, article 30 is, in the preferred embodiment, a tapered wall yogurt container having a flanged lip at its top over which a cap 32 is applied. Cap 32 projects outwardly from the tapered side walls of container 30 to form a definite flanged projection or lip 31. Because yogurt containers have the flanged top and tapered side walls as shown, they have not previously been readily adaptable to packaging in the same manner as generally cylindrical articles which, when inserted in a carton, are in contact with adjacent articles at both the top and the bottom to prevent movement of the bottom portions of the articles relative to each other and resist twisting of the box as it is handled.

Figure 6:
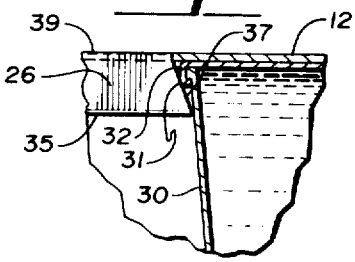
FIG. 6 is a sectional view taken along section line 6—6 in FIG. 2 and showing the interaction of the edge of the lock flap and the side and top of the container.

The inventive carton structure shown herein includes article restraining locks 25, which as shown most clearly in FIG. 6, engage both the flange 31 and the side wall of article 30 of diagonally adjacent articles to apply a restraining or locking force to prevent movement of articles 30 in carton 10. In the preferred embodiment shown, six article restraining locks 25 are used to secure twelve containers 30 within carton 10. One of the article restraining locks 25 is positioned between each grouping of four containers 30 as shown in FIG. 3. The line along which the lower edges 35 of the locks as shown in FIG. 2 are cut, is a line joining the vertical center lines of containers 30 B and 30 C in FIG. 3, which corresponds to the section line 4–4, as shown.

The side edges 37 of flaps 35, when the flaps are parallel to top panels 12 and 13, meet the line along which the lower edges 35 are cut at a nonorthoganal angle which is related to the particular shape of the article 30 which is desired to be loaded in carton 10. For example, in the preferred embodiment shown, the side edges 37 of flaps 26 engage the flanged projection 31 of article 30 at about their midpoint while the intersection of side edge 37 and lower edge 35 engage the tapered side wall of article 30. The lengths of lower edge 35, the distance between lower edge 35 and score lines 39, and the angle between side edged 37 and the line along which lower edges 35 are cut are all selected such that the flaps 26, when downwardly folded from top panels 12 and 13, engage both the flanged projections 31 and the side walls of articles 30 of two diagonally adjacent articles, such as articles 30 B and 30 C shown in FIG. 3 when the flaps are depressed downwardly from the plane of top panels 12 and 13 by an angle of approximately 45° .

After carton 10 is filled with containers 30 and flaps 26 are forced downwardly to engage the tops 32 and side walls of containers 30, a very strong package is achieved. The article restraining locks 25 apply restraining forces to prevent movement of articles 30 in the plane of carton 10 and actually can apply an upward supporting and restraining force to articles 30 as carton 10 is lifted by handles 21.

While the invention hereinbefore described is effectively adapted to fulfill the objects stated, it is to be understood that the invention is not intended to be confined to particular preferred embodiment of the container disclosed, in as much as it is susceptible of various modifications without departing from the scope of the apended claims.

I claim:

1. A carton for carrying a plurality of articles, each of which has a flanged projecting portion located near its upper extremity, said carton comprising spaced top, bottom, and side panels, and article restraining locks comprising pairs of downwardly foldable flaps struck from said top panel with the lower edges of each pair of said flaps being struck from said top panel along a line adjoining the vertical center line of a pair of diagonally adjacent articles loaded in said carton, the side edges of said flaps being angled relative to said line to permit engagement of each side edge with both the flanged portion and the side wall of one of said diagonally adjacent articles when said flaps are downwardly folded.

2. The invention in claim 1 wherein the side edges of said flaps engage the flanged projection at the top of said article and the side wall of said article when said flaps are downwardly folded approximately 45° from the plane of the top panel of said carton.

3. The invention claimed in claim 1 wherein one of said article restraining locks is provided between each group of four articles.

4. The invention claimed in claim 1 wherein the side edges of said foldable flaps are substantially straight lines.

5. The invention claimed in claim 1 wherein the side edges of said foldable flaps engage the flanged projecting portion and the side wall of said article when said flaps are downwardly folded into container engaging position.

* * * * *